US007406897B2

(12) United States Patent
Hsu

(10) Patent No.: US 7,406,897 B2
(45) Date of Patent: Aug. 5, 2008

(54) CLAMPING DEVICE HAVING STEPLESS BRAKING EFFECT

(76) Inventor: Chin Lin Hsu, No. 83-2, Lising Rd., East District, Taichung City (TW) 401

( * ) Notice: Subject to any disclaimer, the term of this patent is extended or adjusted under 35 U.S.C. 154(b) by 227 days.

(21) Appl. No.: 11/268,864

(22) Filed: Nov. 8, 2005

(65) Prior Publication Data

US 2007/0102248 A1 May 10, 2007

(51) Int. Cl.
*B25B 7/14* (2006.01)
*B25B 5/00* (2006.01)
*B25B 3/00* (2006.01)

(52) U.S. Cl. ..... 81/318; 81/320; 81/323

(58) Field of Classification Search ..... 81/318–320, 81/323, 324

See application file for complete search history.

(56) References Cited

U.S. PATENT DOCUMENTS 1,944,116 A * 1/1934 Stratman ..... 81/320
2,539,865 A * 1/1951 Sarvie ..... 81/323
2,620,697 A * 12/1952 Sarvie ..... 81/320
3,313,190 A * 4/1967 Bothum ..... 81/323
3,442,159 A * 5/1969 Sarvie ..... 76/101.1
3,608,404 A * 9/1971 Sarvie ..... 81/323
6,860,179 B2 * 3/2005 Hopper et al. ..... 81/318

* cited by examiner

*Primary Examiner*—David B Thomas
(74) *Attorney, Agent, or Firm*—Banger Shia

(57) ABSTRACT

A clamping device includes two clamping members pivotally connected with each other and each having a first end and a second end, and a braking mechanism mounted between the second ends of the two clamping members to provide a stepless braking effect to the two clamping members. Thus, the braking mechanism provides a stepless braking effect to the two clamping members, so that the two clamping members are movable toward each other freely so as to shorten and adjust the open angle of the holding portion successively to hold a workpiece and are not movable outward relative each other to stop an outward movement of the two clamping members instantaneously so as to fix the holding portion to clamp the workpiece.

16 Claims, 5 Drawing Sheets

CLAMPING DEVICE HAVING STEPLESS BRAKING EFFECT

BACKGROUND OF THE INVENTION

1. Field of the Invention

The present invention relates to a clamping device, and more particularly to a clamping device having a stepless braking effect.

2. Description of the Related Art

A conventional clamping device comprises two opposite clamping members pivotally connected with each other and each having a first end and a second end. The two clamping members are pivotally connected with each other by a pivot shaft which is extended through a mediate portion of each of the two clamping members. The first ends of the two clamping members form a holding portion for holding an article, and the second ends of the two clamping members form a handle portion. An elastic member is mounted between the two clamping members to force the first ends of the two clamping members to move toward each other, so that the holding portion is closed at a normal state so as to clamp the article. However, the first ends of the two clamping members are easily forced to move away from each other by a foreign force or vibration to open the holding portion, so that the article is easily loosened from the holding portion.

A conventional clamping device having a braking mechanism is disclosed in the Taiwanese Patent Publication No. 386480 and 497527.

A conventional clamping device having a ratchet braking mechanism is disclosed in the Taiwanese Patent Publication No. 418767, 421119, 482070, 502684, and 512771.

Another conventional clamping device having a ratchet braking mechanism is disclosed in the U.S. Pat. Nos. D473, 776, 6,240,815 and 6,550,738.

SUMMARY OF THE INVENTION

The present invention is to mitigate and/or obviate the disadvantage of the conventional clamping device.

The primary objective of the present invention is to provide a clamping device having a stepless braking effect.

Another objective of the present invention is to provide a clamping device, wherein the braking mechanism provides a stepless braking effect to the two clamping members, so that the two clamping members are movable toward each other freely so as to shorten and adjust the open angle of the holding portion successively to hold a workpiece and are not movable outward relative each other to stop an outward movement of the two clamping members instantaneously so as to fix the holding portion to clamp the workpiece.

A further objective of the present invention is to provide a clamping device, wherein the braking effect of the braking mechanism is released by pressing the operation face of the braking member, so that the two clamping members are movable outward relative each other freely by the restoring force of the torsion spring so as to expand the open angle of the holding portion largely to hold the workpiece.

In accordance with the present invention, there is provided a clamping device, comprising two opposite clamping members pivotally connected with each other and each having a first end and a second end, and a braking mechanism mounted between the second ends of the two clamping members to provide a stepless braking effect to the two clamping members.

Further benefits and advantages of the present invention will become apparent after a careful reading of the detailed description with appropriate reference to the accompanying drawings.

DETAILED DESCRIPTION OF THE INVENTION

Figure 1:
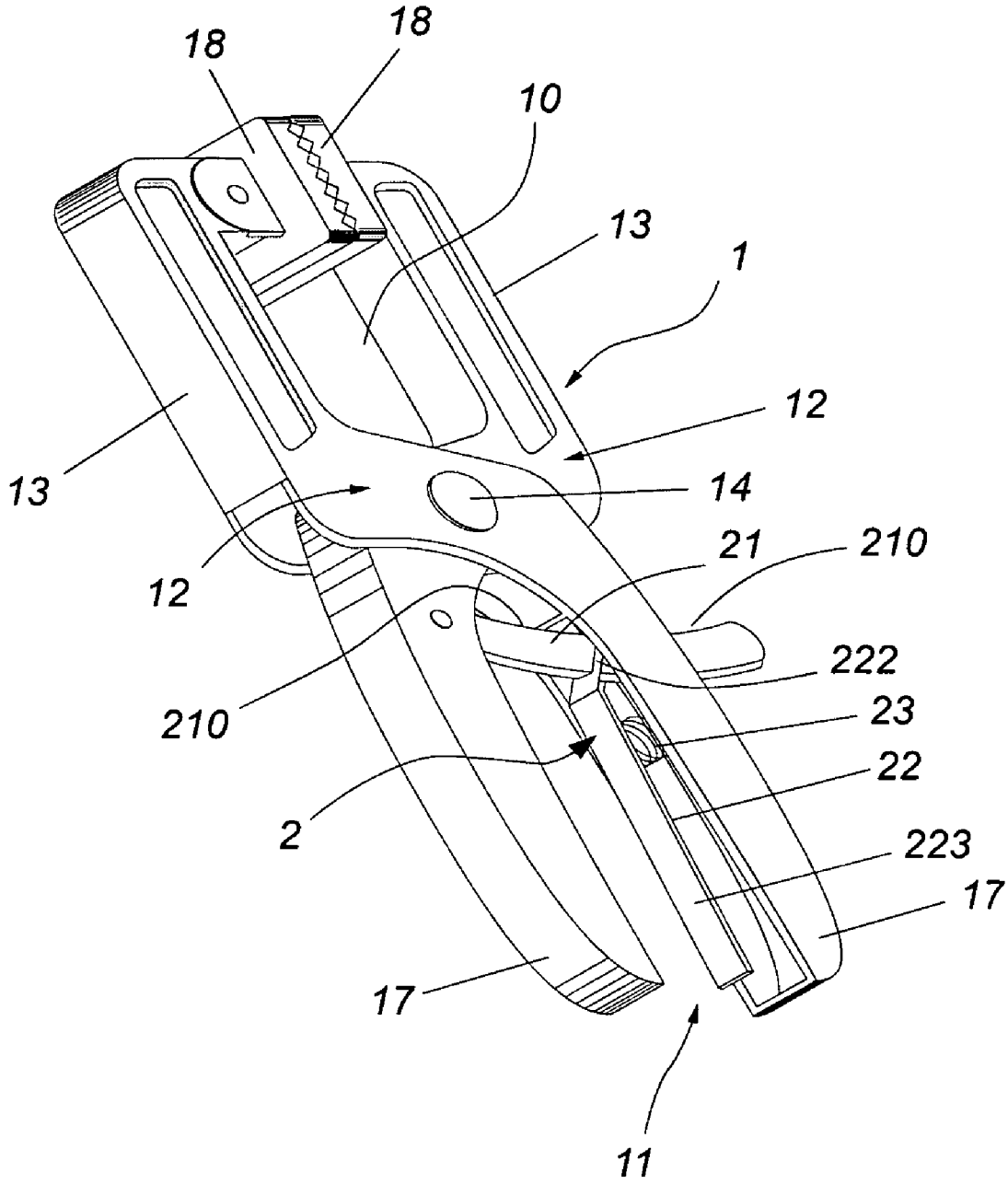
FIG. 1 is a perspective view of a clamping device in accordance with the preferred embodiment of the present invention.
Figure 2:
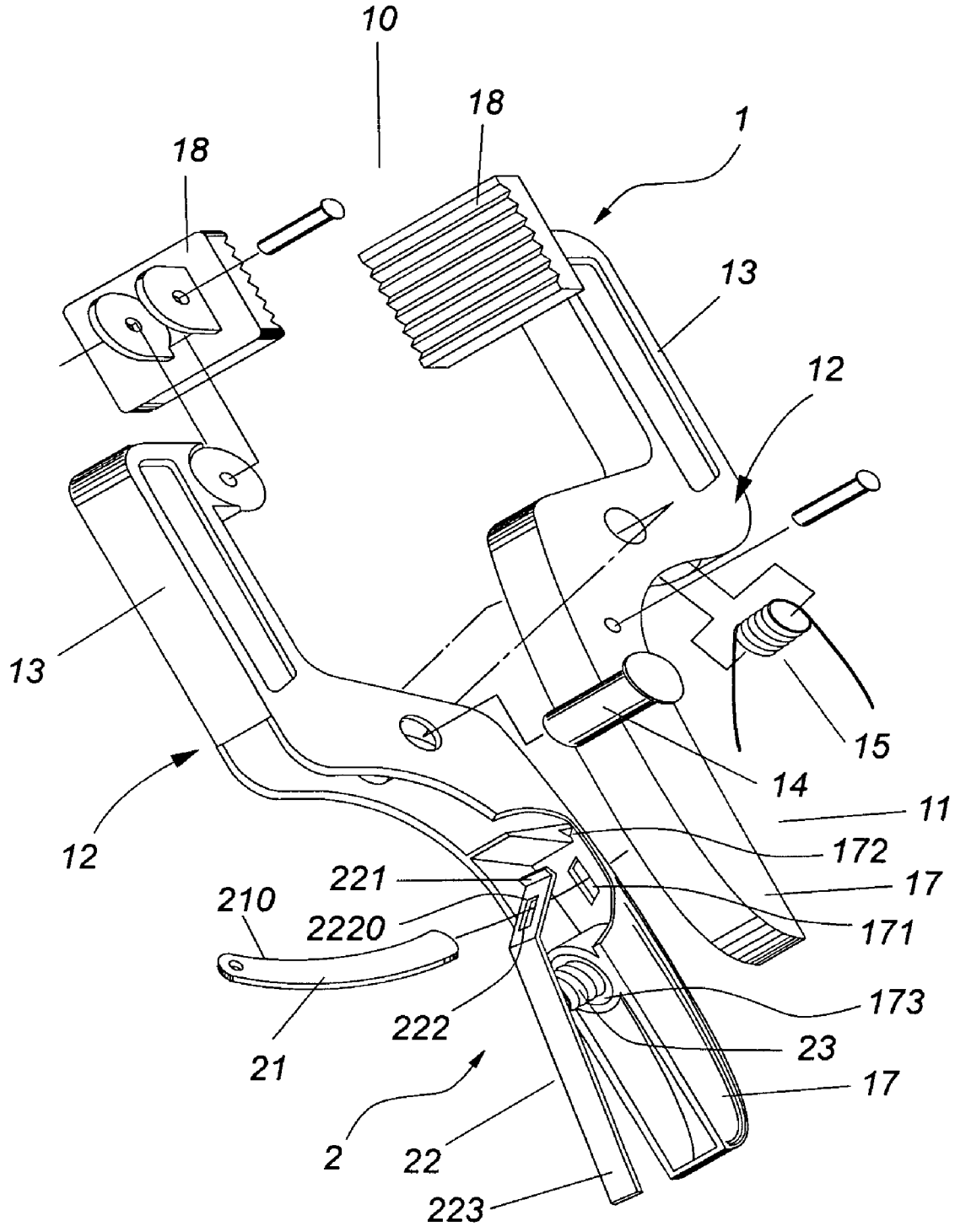
FIG. 2 is an exploded perspective view of the clamping device as shown in FIG. 1.
Figure 3:
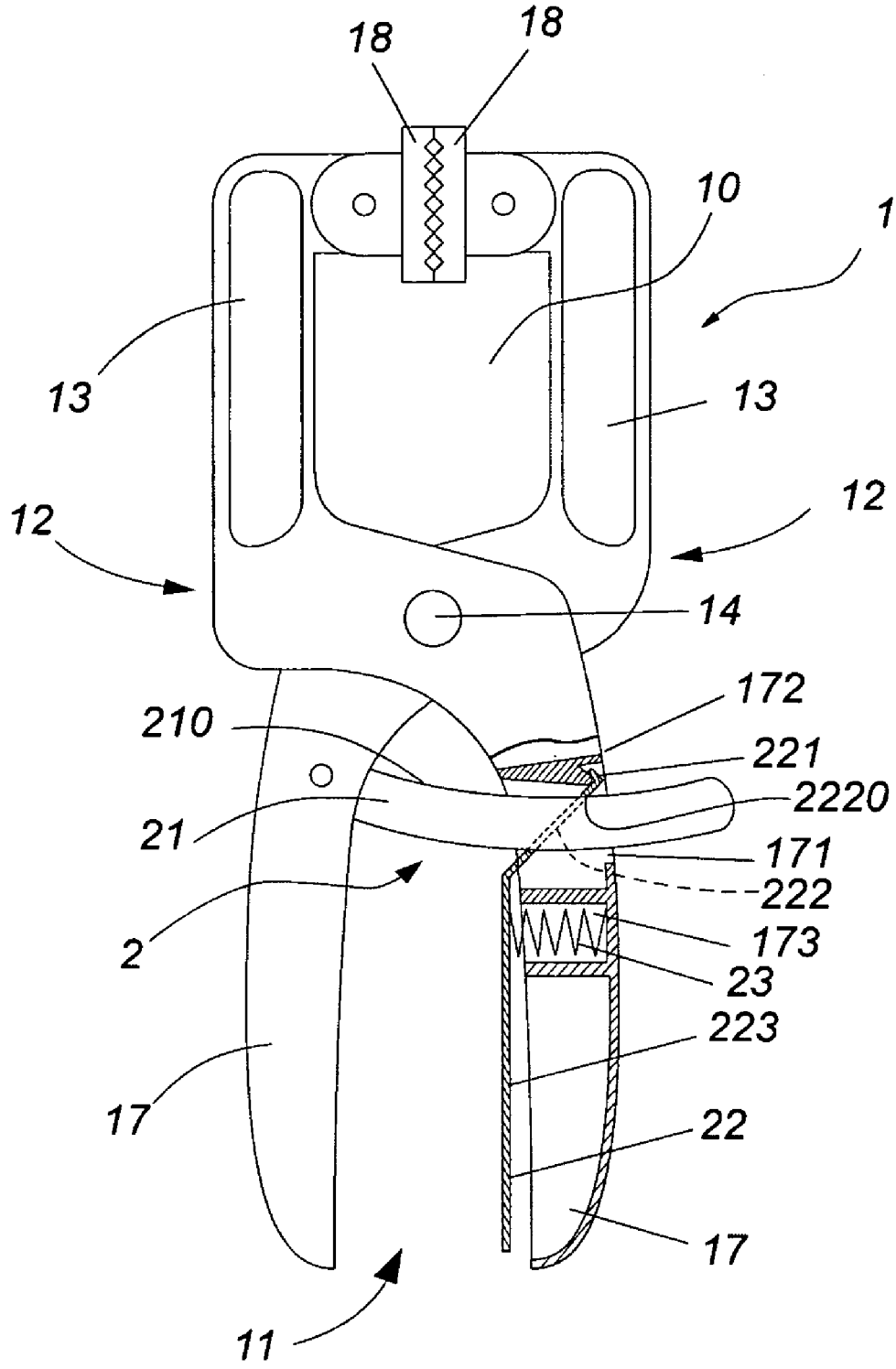
FIG. 3 is a plan cross-sectional view of the clamping device as shown in FIG. 1.

Referring to the drawings and initially to FIGS. 1-3, a clamping device 1 in accordance with the preferred embodiment of the present invention comprises two opposite clamping members 12 pivotally connected with each other and each having a first end 13 and a second end 17, and a braking mechanism 2 mounted between the second ends 17 of the two clamping members 12 to provide a stepless braking effect to the two clamping members 12.

The two clamping members 12 are pivotally connected with each other by a pivot shaft 14 which is extended through a mediate portion of each of the two clamping members 12. The first ends 13 of the two clamping members 12 form a holding portion 10 for holding a workpiece 3, and the second ends 17 of the two clamping members 12 form a handle portion 11. The first end 13 of each of the two clamping members 12 is provided with a serrated protective member 18. A torsion spring 15 is mounted on the pivot shaft 14 and has two ends each urged on an inner side of the second end 17 of the respective clamping member 12 to open the handle portion 11 and to open the holding portion 10 so that the holding portion 10 is opened at a normal state.

The braking mechanism 2 includes a locking member 21 having a first end secured to the second end 17 of a first one of the two clamping members 12 and a second end extended through the second end 17 of a second one of the two clamping members 12, a braking member 22 pivotally mounted on the second one of the two clamping members 12 and having a locking hole 222 releasably locked on the second end of the locking member 21, and an elastic member 23 urged between the second one of the two clamping members 12 and the braking member 22 to push the braking member 22 toward the locking member 21 and the second end 17 of the first one of the two clamping members 12.

The locking member 21 of the braking mechanism 2 is a substantially arc-shaped elongated plate. The locking member 21 of the braking mechanism 2 has a curved locking face 210 releasably locked in the locking hole 222 of the braking member 22. The second end of the locking member 21 of the braking mechanism 2 is in turn extended through the locking hole 222 of the braking member 22 and a through hole 171 formed in the second end 17 of the second one of the two clamping members 12 and protrudes outward from the second end 17 of the second one of the two clamping members 12.

The braking member 22 of the braking mechanism 2 is an elongated bent plate. The braking member 22 of the braking mechanism 2 has a first portion pivotally mounted on the second end 17 of the second one of the two clamping members 12 and a second portion inclined relative to the first portion and having a flat operation face 223 rested on the elastic member 23. The first portion of the braking member 22 has a length smaller than that of the second portion of the braking member 22. The first portion of the braking member 22 has a distal end formed with a pivot portion 221 pivotally mounted on a pivot seat 172 formed on the second end 17 of the second one of the two clamping members 12. The locking hole 222 of the braking member 22 is formed in the first portion of the braking member 22 and located between the pivot portion 221 and the operation face 223. The locking hole 222 of the braking member 22 is inclined relative to the locking member 21 and has a locking edge 2220 releasably locked on the locking face 210 of the locking member 21.

The elastic member 23 of the braking mechanism 2 is mounted in a receiving chamber 173 formed in the second end 17 of the second one of the two clamping members 12 and urged between the second end 17 of the second one of the two clamping members 12 and the operation face 223 of the braking member 22 to push the braking member 22 toward the locking member 21 so that the locking edge 2220 of the locking hole 222 of the braking member 22 is locked on the locking face 210 of the locking member 21 at a normal state.

Figure 4:
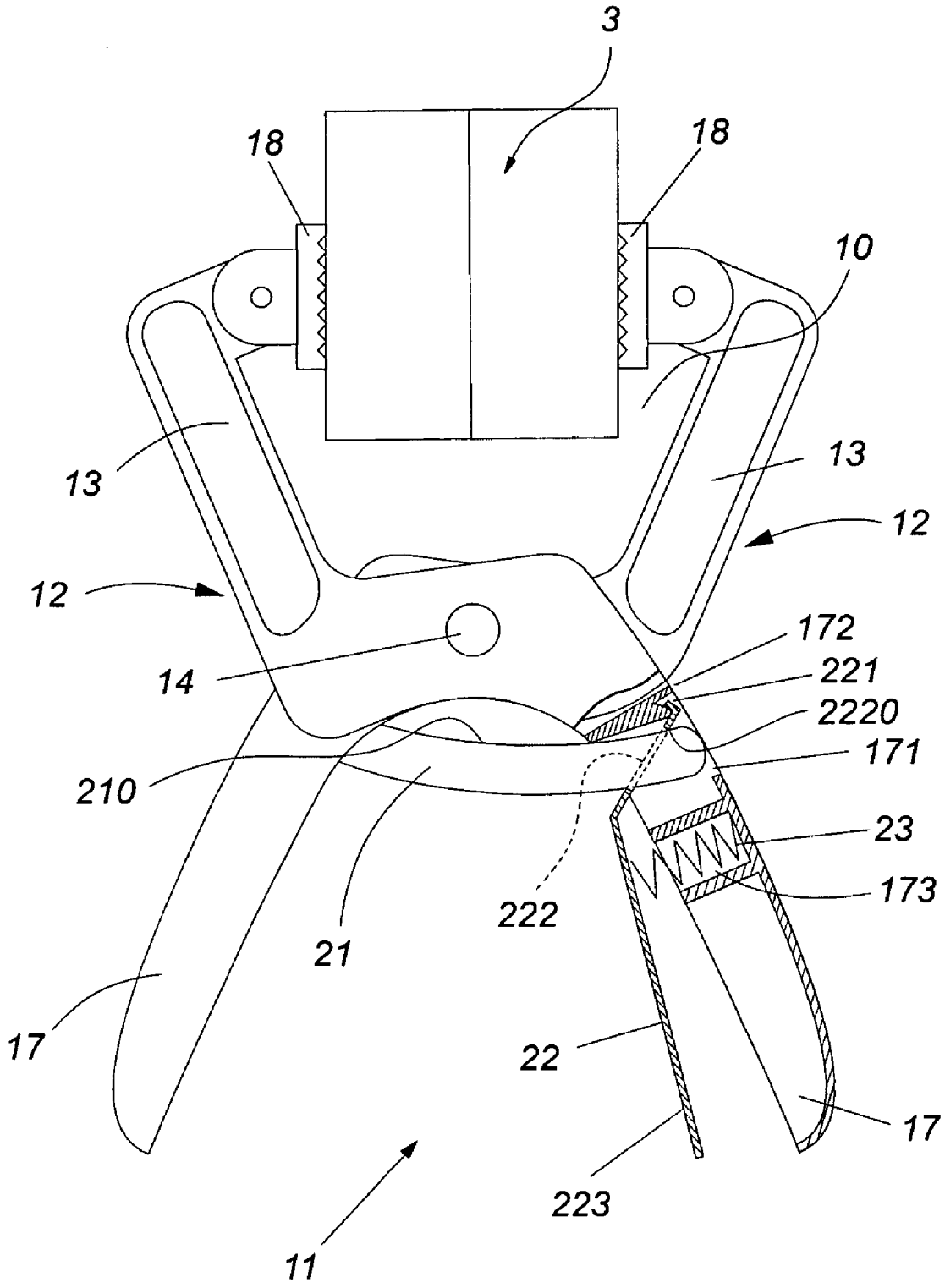
FIG. 4 is a schematic operational view of the clamping device as shown in FIG. 3.

In operation, referring to FIGS. 1-4, when the second ends 17 of the two clamping members 12 are movable toward each other, the locking edge 2220 of the locking hole 222 of the braking member 22 is slidable on the locking face 210 of the locking member 21, so that the two clamping members 12 are movable toward each other freely from the position as shown in FIG. 4 to the position as shown in FIG. 3 so as to close the holding portion 10 successively.

On the contrary, when the second ends 17 of the two clamping members 12 are movable outward relative each other, the locking edge 2220 of the locking hole 222 of the braking member 22 is locked on the locking face 210 of the locking member 21, so that the two clamping members 12 are not movable outward relative each other to stop an outward movement of the two clamping members 12 instantaneously so as to fix the holding portion 10.

Thus, the braking mechanism 2 provides a stepless braking effect to the two clamping members 12, so that the two clamping members 12 are movable toward each other freely so as to shorten the span of the holding portion 10 successively to hold a workpiece 3 as shown in FIG. 4 and are not movable outward relative each other to stop an outward movement of the two clamping members 12 instantaneously so as to fix the holding portion 10 to clamp the workpiece 3.

Figure 5:
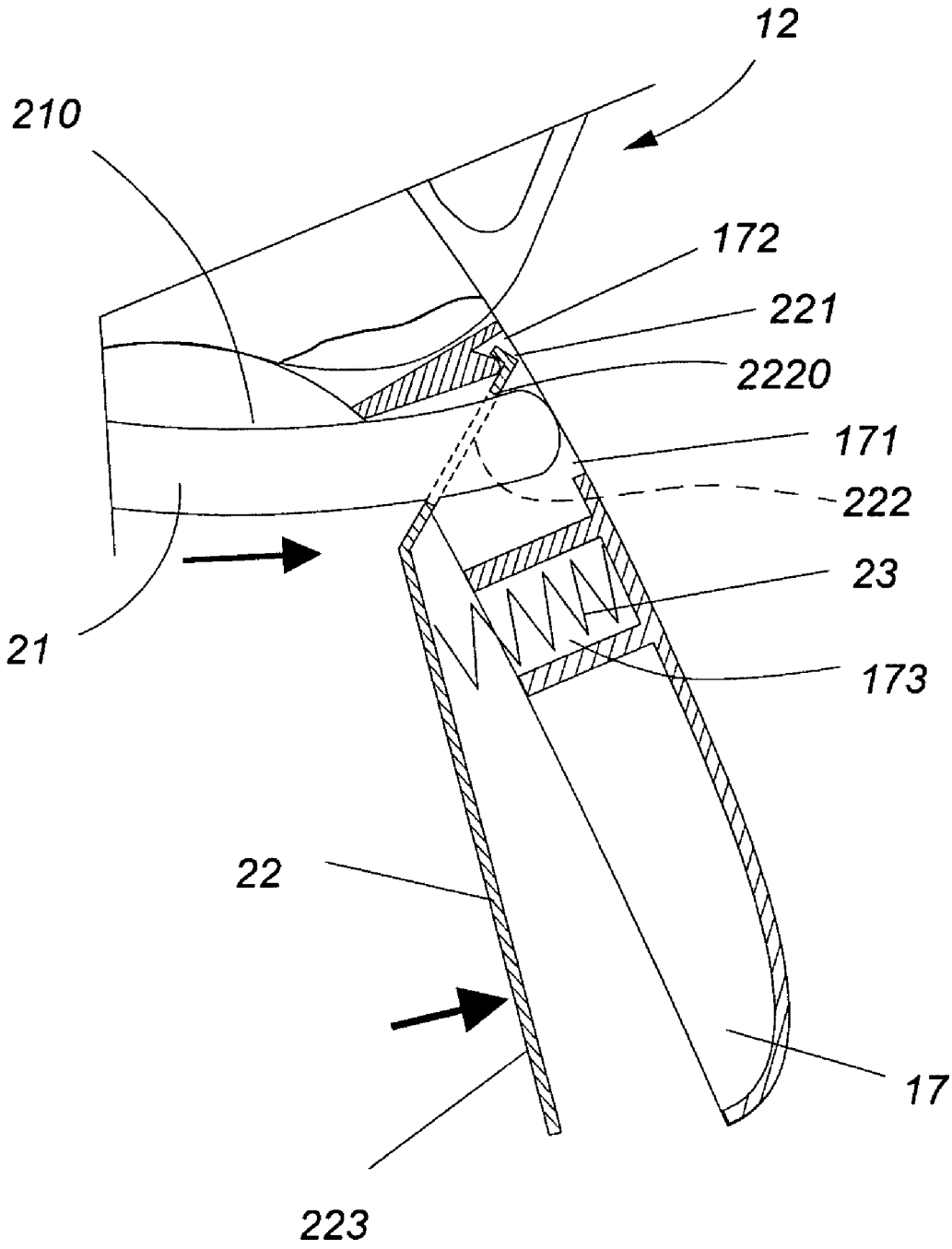
FIG. 5 is a schematic operational view of the clamping device as shown in FIG. 4.

Referring to FIG. 5, when the operation face 223 of the braking member 22 is pressed toward the second end 17 of the second one of the two clamping members 12, the braking member 22 of the braking mechanism 2 is pivoted relative to the locking member 21 to release the locking edge 2220 of the locking hole 222 of the braking member 22 from the locking face 210 of the locking member 21, so that the two clamping members 12 are movable outward relative each other from the position as shown in FIG. 3 to the position as shown in FIG. 4 by the restoring force of the torsion spring 15 so as to adjust the open angle of the holding portion 10 to hold the workpiece 3.

Accordingly, the braking mechanism 2 provides a stepless braking effect to the two clamping members 12, so that the two clamping members 12 are movable toward each other freely so as to shorten and adjust the open angle of the holding portion 10 successively to hold a workpiece 3 and are not movable outward relative each other to stop an outward movement of the two clamping members 12 instantaneously so as to fix the holding portion 10 to clamp the workpiece 3. In addition, the braking effect of the braking mechanism 2 is released by pressing the operation face 223 of the braking member 22, so that the two clamping members 12 are movable outward relative each other freely by the restoring force of the torsion spring 15 so as to expand the open angle of the holding portion 10 largely to hold the workpiece 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A clamping device, comprising:

two opposite clamping members pivotally connected with each other and each having a first end and a second end;

a braking mechanism mounted between the second ends of the two clamping members to provide a stepless braking effect to the two clamping members;

wherein the braking mechanism includes a locking member having a first end secured to the second end of a first one of the two clamping members and a second end extended through the second end of a second one of the two clamping members, a braking member pivotally mounted on the second one of the two clamping members and having a locking hole releasably locked on the second end of the locking member, and an elastic member urged between the second one of the two clamping members and the braking member to push the braking member toward the locking member and the second end of the first one of the two clamping members;

the braking member of the braking mechanism has a first portion pivotally mounted on the second end of the second one of the two clamping members and a second portion inclined relative to the first portion and having a flat operation face rested on the elastic member;

the flat operation face is a straight sheet plate and extends through a whole length of the second portion of the braking member;

the elastic member of the braking mechanism is urged between the second end of the second one of the two clamping members and the operation face of the braking member to push the braking member toward the locking member so that the locking hole of the braking member is locked on the locking member at a normal state;

the first portion of the braking member has a distal end formed with a hook-shaped pivot portion pivotally mounted on a V-shaped pivot seat formed on the second end of the second one of the two clamping members.

2. The clamping device in accordance with claim 1, wherein the locking member of the braking mechanism is a substantially arc-shaped elongated plate.

3. The clamping device in accordance with claim 1, wherein the locking member of the braking mechanism has a curved locking face releasably locked in the locking hole of the braking member.

4. The clamping device in accordance with claim 3, wherein the locking hole of the braking member has a locking edge releasably locked on the locking face of the locking member.

5. The clamping device in accordance with claim 4, wherein the elastic member of the braking mechanism is urged between the second end of the second one of the two clamping members and the braking member to push the braking member toward the locking member so that the locking edge of the locking hole of the braking member is locked on the locking face of the locking member at a normal state.

6. The clamping device in accordance with claim 4, wherein when the second ends of the two clamping members are movable toward each other, the locking edge of the locking hole of the braking member is slidable on the locking face of the locking member, so that the two clamping members are movable toward each other freely.

7. The clamping device in accordance with claim 4, wherein when the second ends of the two clamping members are movable outward relative each other, the locking edge of the locking hole of the braking member is locked on the locking face of the locking member, so that the two clamping members are not movable outward relative each other to stop an outward movement of the two clamping members instantaneously.

8. The clamping device in accordance with claim 1, wherein the second end of the locking member of the braking mechanism is in turn extended through the locking hole of the braking member and a through hole formed in the second end of the second one of the two clamping members.

9. The clamping device in accordance with claim 1, wherein the second end of the locking member of the braking mechanism protrudes outward from the second end of the second one of the two clamping members.

10. The clamping device in accordance with claim 1, wherein the braking member of the braking mechanism is an elongated bent plate.

11. The clamping device in accordance with claim 1, wherein the first portion of the braking member has a length smaller than that of the second portion of the braking member, and the flat operation face of the braking member has a length greater than that of the first portion of the braking member.

12. The clamping device in accordance with claim 1, wherein the locking hole of the braking member is formed in the first portion of the braking member and located between the pivot portion and the operation face.

13. The clamping device in accordance with claim 1, wherein the locking hole of the braking member is inclined relative to the locking member.

14. The clamping device in accordance with claim 1, wherein when the operation face of the braking member is pressed toward the second end of the second one of the two clamping members, the braking member of the braking mechanism is pivoted relative to the locking member to release the locking hole of the braking member from the locking member, so that the two clamping members are movable outward relative each other.

15. The clamping device in accordance with claim 1, wherein the first ends of the two clamping members form a holding portion, and the second ends of the two clamping members form a handle portion.

16. A clamping device, comprising:

two opposite clamping members pivotally connected with each other and each having a first end and a second end;

a braking mechanism mounted between the second ends of the two clamping members to provide a stepless braking effect to the two clamping members;

wherein the braking mechanism includes a locking member having a first end secured to the second end of a first one of the two clamping members and a second end extended through the second end of a second one of the two clamping members, a braking member pivotally mounted on the second one of the two clamping members and having a locking hole releasably locked on the second end of the locking member, and an elastic member urged between the second one of the two clamping members and the braking member to push the braking member toward the locking member and the second end of the first one of the two clamping members;

the braking member of the braking mechanism has a first portion pivotally mounted on the second end of the second one of the two clamping members and a second portion inclined relative to the first portion and having a flat operation face rested on the elastic member;

the flat operation face is a straight sheet plate and extends through a whole length of the second portion of the braking member;

the elastic member of the braking mechanism is urged between the second end of the second one of the two clamping members and the operation face of the braking member to push the braking member toward the locking member so that the locking hole of the braking member is locked on the locking member at a normal state;

the elastic member of the braking mechanism is mounted in a receiving chamber formed in the second end of the second one of the two clamping members, and the second end of the second one of the two clamping members has a side provided with a recess located beside the receiving chamber to receive the first portion of the braking member so that the first portion of the braking member is hidden in the recess of the second one of the two clamping members.

* * * * *